US005217701A

United States Patent [19]

Sakata et al.

[11] Patent Number: 5,217,701

[45] Date of Patent: Jun. 8, 1993

[54] PROCESS FOR PRODUCING CARBON MATERIALS

[75] Inventors: Koji Sakata; Kouji Sakawaki, both of Kitakyushu, Japan

[73] Assignee: Mitsui Mining Company, Limited, Tokyo, Japan

[21] Appl. No.: 523,274

[22] Filed: May 14, 1990

[30] Foreign Application Priority Data

Aug. 21, 1987 [JP] Japan ..... 62-206476
Mar. 9, 1988 [JP] Japan ..... 63-053802

[51] Int. Cl.[5] ..... C01B 31/02

[52] U.S. Cl. ..... 423/447.1; 423/447.4; 423/447.6; 264/29.1; 264/29.2

[58] Field of Search ..... 423/445, 447.1, 447.2, 423/447.4, 447.6, 460; 264/29.1, 29.2

[56] References Cited

U.S. PATENT DOCUMENTS 2,899,713 8/1959 Lundsager ..... 264/29.1
3,723,609 3/1973 Mansmann et al. ..... 423/447
3,835,183 9/1974 Carpenter et al. ..... 423/460
4,024,076 5/1977 Miyake et al. ..... 423/447.4
4,070,446 1/1978 Horikiri et al. ..... 423/447.4
4,336,022 6/1982 Lynch et al. ..... 423/447.2
4,401,588 8/1983 Turner ..... 423/447.1
4,412,675 11/1983 Kauakubo ..... 423/449
4,793,912 12/1988 Tate et al. ..... 423/447.1

FOREIGN PATENT DOCUMENTS 47-049992 5/1972 Japan .
47-22653 6/1972 Japan ..... 423/447.1
49-95523 5/1974 Japan ..... 423/447.2
52-063209 5/1977 Japan .
61-36085 8/1986 Japan .

*Primary Examiner*—Robert Kunemund
*Attorney, Agent, or Firm*—Oblon, Spivak, McClelland, Maier & Neustadt

[57] ABSTRACT

Disclosed is a process for producing carbon materials which comprises the steps of preparing a raw material composition by mixing a methylene type linkage-containing condensation product of an aromatic sulfonic acid or a salt thereof with a solvent, the condensation product having been formed by means of a linkage of the formula $$-(CH_2)_n-T_x-(CHR)_m- \quad (1)$$

where T is a benzene or naphthalene ring, R is a hydrogen atom, an alkyl group of 1 to 4 carbon atoms, or a benzene ring, and each of n, m and x is 0 or 1, but n and m should not be zero at the same time; spinning or molding the raw material composition; and carbonizing the spun fiber or molded article. Preferably, the aforesaid linkage is $-CH_2-$.

6 Claims, No Drawings

PROCESS FOR PRODUCING CARBON MATERIALS

This application is a continuation of application Ser. No. 07/233,744 filed on Aug. 19, 1988, now abandoned.

BACKGROUND OF THE INVENTION

1. Field of the Invention

This invention relates to a process for producing carbon material which can be used either in the form of fibers or various molded articles as fillers for various composite materials, heat insulating materials and ablation materials, or in the form of activated carbon materials including molecular sieve carbon materials, activated carbon fibers and the like as adsorbent or separating materials.

2. Description of the Related Art

Among carbon materials in such fibrous forms as generally called carbon fibers, molecular sieve carbon fibers or activated carbon fibers, carbon fibers are produced by spinning rayon, lignin, polyacrylonitrile (hereinafter referred to as PAN), pitch or the like, rendering the spun fiber infusible, carbonizing it at a temperature of 1,000° to 1,600° C,,or further graphitizing the resulting carbon fiber at a temperature of 2,000° to 3,000° C. On the other hand, molecular sieve carbon fibers and activated carbon fibers are produced either by spinning a raw material as described above, rendering the spun fiber infusible, and then activating it, or by rendering the spun fiber infusible, carbonizing it, and then activating the resulting carbon fiber.

Although these carbon materials in fibrous form have excellent properties which are not possessed by other materials, they involve several operational problems as described in the following paragraphs (1) to (3). Therefore, these carbon materials are high in price and still far from being widely used as common industrial materials.

(1) In order to provide industrially practicable spinnability, the spinning material must previously be freed of any foreign matter by high-precision filtration.

(2) Rayon and PAN are spun according to the wet or dry spinning technique, which involves the cost of solvent recovery. On the other hand, the spinning of lignin and pitch produces tar and mist, so that it is important to control the spinning atmosphere.

(3) All of the fibers spun from the aforesaid raw materials require a treatment for rendering them infusible. Generally, this treatment is carried out by air oxidation. In this treatment, a long treating time, large-capacity oxidizing equipment and the like are needed to prevent violent exothermic reaction, i.e., combustion.

In order to eliminate the time-consuming step of rendering the spun fiber infusible by air oxidation, there has been proposed a process in which fibrous polystyrene is soaked in sulfuric acid and then carbonized (Japanese Patent Publication No. 36085/'86). However, this process has the disadvantage that the sulfonation of polystyrene (i.e., the introduction of sulfonic groups into polystyrene) is not effected uniformly throughout the entire fiber. That is, spots rendered infusible, spots made fragile due to excessive sulfonation, and spots not rendered infusible are formed in the fiber surfaces, resulting in a very inhomogeneous fiber.

SUMMARY OF THE INVENTION

It is the primary object of the present invention to provide a process for producing carbon materials by which the above-described problems of the prior art can be solved and in which carbon materials having the form of fibers or molded articles (such as honeycombs) and useful as components for various composite materials and as adsorbent or separating materials can be produced by easy and simple operation.

In view of the above and other objects, the present inventors have made an intensive investigation and have found that the above-described problems can be solved by using a methylene type linkage-containing condensation product of an aromatic sulfonic acid or a salt thereof as the spinning or molding material. The present invention has been completed on the basis of this finding.

According to the present invention, there is provided a process for producing carbon materials which comprises the steps of preparing a raw material composition comprising a methylene type linkage-containing condensation product of an aromatic sulfonic acid or a salt thereof and a solvent, the condensation product having been formed by means of a linkage of the formula $$-(CH_2)-T_x-(CHR)_m- \quad (1)$$

where T is a benzene or naphthalene ring, R is a hydrogen atom, an alkyl group of 1 to 4 carbon atoms, or a benzene ring, and each of n, m and x is 0 or 1, but n and m should not be zero at the same time; spinning or molding the raw material composition; and carbonizing the spun fiber or molded article.

DETAILED DESCRIPTION OF THE INVENTION

Specific examples of the aromatic sulfonic acid, or salt thereof, which is used in the present invention include naphthalenesulfonic acid, anthracenesulfonic acid, phenanthrenesulfonic acid, sulfonated products of polycyclic aromatic compound mixtures (such as creosote oil, anthracene oil, tar and pitch), toluenesulfonic acid, xylenesulfonic acid, sulfonated phenols and mixtures thereof, as well as salts of the foregoing. These aromatic sulfonic acids can be obtained by sulfonating the corresponding aromatic compounds according to any of various well-known methods. Although the cation constituting salts of the aromatic sulfonic acids can be $Na^+$, $K^+$, $Ca^{+2}$, $NH_4^+$ and the like, ammonium salts are preferred because of the ease with which the spun fiber can be handled in the carbonization step. Moreover, preferred salts may vary according to the desired type of carbon material. That is, ammonium salts are preferred for the production of carbon materials requiring strength. In order to produce porous adsorbent materials or separating materials, ammonium salts can be used satisfactorily, but sodium and calcium salts are more preferred.

Condensation products of the above-described aromatic sulfonic acids or salts thereof can be prepared according to any of various well-known methods. However, it is common practice to condensate an aromatic sulfonic acid or a salt thereof with the aid of formalin, paraformaldehyde, hexamethylenetetramine or other aldehyde. It is also possible to use a methylene type linkage-containing polymer (such as polystyrenesulfonic acid) obtained by polymerizing an aromatic sulfonic acid having a vinyl group. Although the linkage connecting molecules of the aromatic sulfonic acid may be any of the linkages within the scope of formula (1), the $-CH_2-$ linkage is especially preferred because methylene-linked condensation products are easy to prepare or obtain. And the linkage in a methylene type linkage-containing condensation product of an aromatic sulfonic acid or a salt thereof as said in the present invention, includes not only those which connect directly with an aromatic ring but also those which connect by means of side chains as in the case of a polystyrenesulfonic acid.

Various types of condensation products can be obtained, depending on the type of aromatic compound used, the conditions of sulfonation and condensation reactions, and the like. Of course, these condensation products may be used alone or in admixture of two or more, and may also be used in the form of polycondensation products.

As an example of the methylene type linkage-containing condensation product of aromatic sulfonic acid, or salt thereof, which is used in the process of the present invention, mention is made of a condensation product obtained by condensing ammonium naphthalene-$\beta$-sulfonate with the aid of formaldehyde. This condensation product is a mixture of monomer and various polymers having polymerization degrees of up to about 200, and has a number-average molecular weight of about 2,000 to 50,000. This condensation product is a solid at ordinary temperatures, sparingly soluble in organic solvents such as benzene, toluene and acetone, and readily soluble in aqueous solvents. A 60% (w/w) aqueous solution thereof has a viscosity of about 10 to 20,000 poises at 60° C. and exhibits adequate spinnability and moldability. When this condensation product is carbonized at a temperature of 800° to 1,000° C., the yield of the resulting carbon material is about 50% by weight.

The above-described condensation product is only one example of the condensation products useful in the process of the present invention, and it is to be understood that the range of the polymerization degree, or number-average molecular weight, of a condensation product useful in the process of the present invention depends on the type of the aromatic sulfonic acid, or salt thereof, constituting the condensation product. For example, a useful condensation product of sulfonated creosote oil is a mixture of monomer and various polymers having polymerization degrees of up to about 40, and has a number-average molecular weight of about 2,000 to about 5,000. A useful condensation product of phenanthrenesulfonic acid is a mixture of monomer and various polymers having polymerization degrees of up to about 30, and has a number-average molecular weight of about 2,500 to about 5,000.

The above-defined condensation product or polymer of aromatic sulfonic acid or salt thereof is dissolved or dispersed in a solvent to prepare a raw material composition. If necessary, the viscosity of this raw material composition is adjusted by suitable means such as dilution and concentration. Then, the raw material composition is spun into fibrous form or molded into any desired shape such as block, column, plate, film or honeycomb. Finally, the spun fiber or molded article is carbonized to obtain a carbon material.

In view of the properties of the condensation product or polymer of aromatic sulfonic acid or salt thereof, the solvent used in the process of the present invention is preferably selected from polar solvents including water, alcohols (such as methanol), acetonitrile and the like. Among others, it is most preferable to use water or an aqueous solvent comprising a mixture of water and a suitable water-soluble solvent.

Where a carbon material in fibrous form is to be produced by the process of the present invention, it is undesirable that the aromatic sulfonic acid used as the raw material contains a high proportion of unsulfonated aromatic compounds, because they make the resulting carbon fibers inhomogeneous and cause a reduction in strength. In such a case, the methylene type linkage-containing condensation products of unsulfonated aromatic compounds can be removed by using water as the solvent. That is, since the methylene-linked condensation products of unsulfonated aromatic compounds are hardly soluble in water and, therefore, can be separated from the spinning solution according to suitable techniques such as filtration, centrifugation and dialysis. Moreover, the use of an aqueous solvent is preferred from operational points of view, because the spinning atmosphere can be controlled easily and there is no risk of ignition or explosion.

In the process of the present invention, the spinnability and moldability of the raw material composition can further be improved by adding a watersoluble polymeric compound, as a spinning or molding aid, to the raw material composition in an amount of 0.02 to 20 parts by weight per 100 parts by weight of the solid constituent of the raw material composition. The water-soluble polymeric compound used in the present invention can be any of various polymeric compounds that are soluble or colloidally dispersible in water and aqueous solvents. Especially preferred are polyalkylene oxide compounds such as condensation products of ethylene oxide, propylene oxide, etc., and condensation products obtained by the reaction of these compounds with various alcohols, fatty acids, alkylamines and alkylphenols; polyvinyl compounds such as polyvinyl alcohol and polyvinyl pyrrolidone; polyacrylic compounds such as polyacrylic acid, polyacrylamide and acrylic acid-acrylamide copolymer; and the like. Among the methylene-linked condensation products of aromatic sulfonic acids, or salts thereof, which can be used as the raw material in the process of the present invention, those having high solubility in water (such as polystyrenesulfonic acid) can also be used as the water-soluble polymeric compound. The addition of such a water-soluble polymeric compound is effective in accelerating the spinning speed, making it easy to handle the spun fiber or molded article prior to carbonization, and increasing the strength of the resulting carbon fiber or molded product. If the amount of water-soluble polymeric compound added is less than 0.02 part by weight, a satisfactory effect cannot be obtained. If it is greater than 20 parts by weight, the fiber or the like is liable to fusion during the heating operation for carbonization. This is undesirable because a separate step of rendering it infusible is required.

As described above, the methylene type linkage-containing condensation product of aromatic sulfonic acid or salt thereof, which is used in the process of the present invention, can be spun or molded and then carbonized to produce carbon materials in fibrous form and in various other forms. However, on the basis of the feature that the aforesaid condensation product can be carbonized without being rendered infusible, the process of the present invention is particularly suitable for the production of carbon materials in fibrous form.

The content of the condensation product in the raw material composition for spinning (i.e., the spinning material) may vary according to the types of the condensation product, water-soluble polymeric compound and solvent. However, it is generally in the range of 20 to 80% by weight and preferably in the range of 40 to 70% by weight.

In the spinning material liquid there are sometimes produced impurities from the raw materials or derivative substances, whether in solid or gel, resulted from reaction by-products among the raw materials. The removal of such impurities or substances is effective in gaining a high-spinnability or an improved quality of carbon materials in fibrous form. Though it can be made outside a spinning machine, the removal can be far effectively carried out by placing a sintered metal filter, a sintered metal fibrous filter, a sintered metal wire netting filter or a pack filter of various metal fillers upon a spinneret.

The spinning temperature may vary according to the composition of the spinning material, the desired shape of fiber, and the like. However, where water is used as the solvent, the spinning temperature is preferably in the range of 20° to 100° C. The fiber emerging from the spinneret is drawn out by means of a wind-up roll, godet rolls, an air sucker or the like, is wound up or is accumulated in a receiver after having been dried within a barrel dryer equipped under the spinneret, preferably in a heated-air stream flowing in parallel to the progress of the fiber. A draft ratio (i.e., the spinneret's diameter/the spun fiber's diameter) where the fiber is drawn out, can be 100 to 2; however, a preferable range of it is 10 to 5. A fiber with a big surface can be also produced by applying a spinneret of irregular form in order to ease the drying of the fiber and enhance the fibrous strength. Although the diameter of the spun fiber may be determined aribitrarily, it is preferably in the range of 2 to 100 μm and more preferably in the range of 8 to 20 μm.

There is a possibility that the spun fiber might absorb humidity and melt into another one because of its hygroscopicity if it is left for a long time in the open air. Accordingly, it is favorable soon to send the spun fiber to the carbonization process or to stock it in the dry air when necessary.

According to the process of the present invention, the spun fiber can be carbonized without being rendered infusible. In the carbonization process the spun fiber is fired by heating at a thermal ascending speed of 1° to 2,000° C./min., preferably 10° to 500° C./min., up to a temperature of 500° to 2,000° C., but under a non-oxidation atmosphere such as in a stream of $N_2$ or other non-activated gases.

In the case of the raw material being an ammonium salt of a methylene type condensation product of an aromatic sulfonic acid, a sulfurous acid and an ammonium root are eliminated in the principal range of 250° to 350° C. during the carbonization, when the raw material of about 50% by weight is lost. In order to prevent the derogation of fibrous quality owing to a sudden elimination of volatile matters, it is favorable that thermal ascending is made at a gentle speed in the range of 250° to 350° C. or that a thermal retention time in the same thermal range is included in a thermal program for the carbonization. The fiber may further be fired at a temperature of 2,000° to 3,000° C. to obtain a carbon fiber comprising graphite. In addition, its properties (e.g., tensile strength) can further be improved by drawing the fiber during the firing operation.

Where a carbon material in the form of a molded article is to be produced by the process of the present invention, the content of the condensation product in the raw material composition for molding (i.e., the molding material) may vary according to the types of the condensation product, water-soluble polymeric compound and solvent. However, it is generally in the range of 20 to 90% by weight and preferably in the range of 40 to 80% by weight.

The molded article can be carbonized under substantially the same conditions as employed for the spun fiber.

In a preferred embodiment of the present invention, a continuous process can be established which comprises sulfonating the aromatic compound used as the raw material, condensing it with the aid of formalin or the like while controlling the water content and pH of the reaction system, neutralizing the condensation product, removing any insoluble matter according to the need, adjusting the viscosity of the condensation product (e.g., by controlling its water content) to prepare a spinning or molding material, spinning or molding it, and then carbonizing the spun fiber or molded article to obtain a carbon material. Moreover, better results can be obtained by adding the above-described water-soluble polymeric compound at the time of preparation of the spinning or molding material.

The properties of carbon fibers produced by the process of the present invention will vary according to the type of the aromatic compound, or salt thereof, used in the spinning material, the diameter of the fiber, and the like. More specifically, the strength of the resulting fiber increases with a rise in carbonization temperature. For example, the fiber fired at 600° C. has a strength of 20 to 50 kg/mm$^2$ and the fiber fired at 1,200° C. has a strength of 40 to 200 kg/mm$^2$.

The carbon materials produced by the process of the present invention have a relatively large specific surface area because the elimination of sulfonic groups occurs in the carbonization step. Moreover, since the-raw material is sulfonated while it is in the low-molecular-weight state, the sulfonic groups are distributed evenly. Therefore, the carbon materials produced by the present invention are more homogeneous and have more excellent properties than those produced by conventional methods such as the treatment of polymers with sulfuric acid. These carbon materials, especially in fibrous form, can be used as fillers for various composite materials and as heat insulating materials. Moreover, by further subjecting them to an activation treatment, they can also be used as adsorbent or separating materials, including molecular sieve carbon materials, activated carbon fibers and the like.

The activation treatment can be carried out in the same manner as for the, preparation of ordinary activated carbon and the like. Specifically, the carbon materials of the present invention may be activated by suitable gases such as steam, air and $CO_2$ or by suitable chemicals such as zinc chloride or sulfuric acid.

The activation treatment may be carried out after the spun fiber or molded article has been carbonized, or while the spun fiber or molded article is being carbonized.

In one embodiment of the activation treatment using steam as the activator, the spun fiber or molded article (not carbonized) is heated at a temperature of 350° C. or above, preferably 450° C. or above, in an atmosphere of an inert gas and then treated with steam at a temperature of 700° to 900° C. for 10 to 120 minutes.

Where an activator (such as $CO_2$) involving no risk of dissolving the spun fiber or molded article is used, the spun fiber or molded article may be directly treated with steam at a temperature of 700° to 1,000° C. for 10 to 180 minutes without heating at a lower temperature.

As a result of the above-described activation treatment, there is obtained an activated carbon material having a specific surface area of 500 to 2,500 $m^2/g$ as measured by the $N_2$ BET method.

According to the process of the present invention, carbon materials having excellent properties and useful in wide applications can be produced by much simpler operation, as compared with prior art processes. Moreover, because of the regular elimination of sulfonic groups, the carbon materials produced thereby have good homogeneity and high activity and, therefore, are of great industrial value.

The process of the present invention will be more specifically explained with reference to the following examples.

EXAMPLE 1

1,280 g of naphthalene having a purity of 95% was mixed with 1,050 g of 98% sulfuric acid and sulfonated at 160° C. for 2 hours. Unreacted naphthalene and the water formed by the reaction were removed from the system by distillation under reduced pressure. Then, 857 g of 35% formalin was added and the resulting mixture was reacted at 105° C. for 5 hours to obtain a methylene-linked condensation product of naphthalene-β-sulfonic acid. Furthermore, this condensation product was neutralized with aqueous ammonia and then filtered through No. 5 filter paper (manufactured by Toyoroshi Kaisha, Ltd.). The filtrate was concentrated to obtain a spinning material in the form of a solution containing 34% by weight of water and having a viscosity of 100 centipoises at 85° C. The resulting salt of the condensation product had a number-average molecular weight of 4,300. This spinning material was dry-spun using a stainless steel spinneret having an orifice diameter of 0.1 mm.

The spun fiber was directly subjected to a carbonization step. Specifically, the fiber was fired in a stream of $N_2$ by raising the temperature from room temperature to 800° C. at a rate of 10° C./min. The resulting carbon fiber had a diameter of 12 μm, a tensile strength of 65 $kg/mm^2$, a specific surface area of 250 $m^2/g$ as measured by the $CO_2$ BET method, and a specific surface area of 30 $m^2/g$ as measured by the $N_2$ BET method. Moreover, when measured at 25° C. under 3 atmospheres, its equilibrium $CO_2$ adsorption was 188 ml/g and its equilibrium $N_2$ adsorption was 25 ml/g.

Furthermore, the above fiber was activated by treatment with steam at 850° C. for 60 minutes. The resulting fiber had a specific surface area of 1,470 $m^2/g$ as measured by the $CO_2$ BET method, and a specific surface area of 1,560 $m^2/g$ as measured by the $N_2$ BET method.

EXAMPLE 2

1,700 g of creosote oil was mixed with 1,050 g of 98% sulfuric acid and sulfonated at 160° C. for 2 hours. Unreacted oil and the water formed by the reaction were removed from the system by distillation. Then, 857 g of a 35% aqueous solution of formalin was added and the resulting mixture was reacted at 105° C. for 5 hours to obtain a methylene-linked condensation product of aromatic sulfonic acids. This condensation product was mixed with 37 g of calcium hydroxide to convert the excess sulfuric acid to gypsum, and then centrifuged to remove it together with water-insoluble gel-like solid matter. After centrifugation, the supernatant liquid was adjusted to a water content of 40% by weight. Thus, spinning material A was obtained in the form of a solution having a viscosity of 100 centipoises at 85° C. On the other hand, spinning material B was prepared by taking a part of spinning solution A, neutralizing it with sodium hydroxide, purifying it again by filtration, and then adjusting the filtrate to a water content of 40% by weight. Spinning material A was spun using a platinum spinneret. The spun fiber was directly subjected to a carbonization step where it was fired in a stream of $N_2$ by raising the temperature from room temperature to 1,200° C. at a rate of 10° C./min. The resulting carbon fiber had a diameter of 15 μm and a tensile strength of 52 $kg/mm^2$ Spinning material B was spun using a stainless steel spinneret. The spun fiber was directly subjected to a carbonization step where it was fired in a stream of $N_2$ by raising the temperature from room temperature to 800° C. at a rate of 10° C./min and then to an activation step by steam at a temperature of 900° C. for 15 minutes. The resulting carbon fiber had a diameter of 12 μm, a tensile strength of 30 $kg/mm^2$, a specific surface area of 720 $m^2/g$ as measured by the $CO_2$ BET method, and a specific surface area of 870 $m^2/g$ as measured by the $N_2$ BET method.

EXAMPLE 3

1,280 g of naphthalene having a purity of 95% was mixed with 1,050 g of 98% sulfuric acid and sulfonated at 158° C. for 1 hour. Unreacted naphthalene and the water formed by the reaction were removed from the system by distillation under reduced pressure. However, 0.6% (based on the charged amount) of unreacted naphthalene remained in the system. Then, 875 g of 35% formalin was added and the resulting mixture was reacted at 105° C. for 5 hours to obtain a methylene-linked condensation product of naphthalene-β-sulfonic acid. This condensation product had a number-average molecular weight of 3,200. Furthermore, the condensation product was neutralized with ammonia and then filtered through No. 5C filter paper (manufactured by Toyoroshi Kaisha, Ltd.). To the filtrate was added a specified amount of an aqueous solution of Poval PVA-217 (manufactured by Kuraray Co., Ltd.; polymerization degree 1,700–2,400). The filtrate containing the watersoluble polymeric compound was concentrated to obtain a spinning material having a viscosity of 20 poises as measured at 85° C. with a Brookfield type viscometer. This spinning material was dry-spun at about 60° C. using a stainless steel spinneret having an orifice diameter of 0.2 mm. The spun fiber was directly subjected to a carbonization step. Specifically, the fiber was placed in a stream of $N_2$ and heated from room temperature to 1,000° C. at a rate of 200° C./min. on the average. During this carbonization process, the fiber was held at 250° C. for 5 minutes and at 1,000° C. for 5 minutes. The spinnability of spinning materials containing various amounts of PVA and some properties of the carbon fibers formed from these spinning materials are shown in Table 1.

TABLE 1

| Amount of PVA added[1] (wt. %) | Water content[2] (wt. %) | Maximum spinning speed (m/min.) | Diameter of carbon fiber (μm) | Strength of carbon fiber (kg/mm²) |
|---|---|---|---|---|
| 0 | 38 | 340 | 18 | 89 |
| 0.02 | 38 | 400 | 16 | 96 |
| 0.2 | 38 | 610 | 14 | 99 |
| 0.4 | 39 | 660 | 14 | 121 |
| 0.8 | 40 | 700 | 14 | 129 |
| 1.6 | 40 | 710 | 15 | 129 |
| 3.2 | 42 | 702 | 15 | 118 |
| 6.4 | 44 | 840 | 19 | 125 |
| 12.8 | 50 | 890 | 19 | 101 |
| 25.0 | 72 | 900 | Fused during carbonization | |

[1]Amount of PVA added: [(Dry weight of PVA)/(Dry weight of condensation product of naphthalene-β-sulfonic acid) × 100 (%).

[2]Water content: Indicates the water content (in wt. %) of the spinning material having undergone viscosity adjustment. (The same will apply to Table 2.)

The carbon fiber having a PVA content of 0.8% was activated by treatment with steam at 850° C. for 60 minutes. The resulting fiber had a specific surface area of 1,400 $m^2/g$ as measured by the $CO_2$ BET method, and a specific surface area of 1,520 $m^2/g$ as measured by the $N_2$ BET method.

EXAMPLE 4

2,000 g of creosote oil was mixed with 1,050 g of 98% sulfuric acid and sulfonated at 158° C. for 1 hour. Unreacted oil and the water formed by the reaction were removed from the system by distillation. Then, 357 g of a 35% aqueous solution of formalin was added and the resulting mixture was reacted at 105° C. for 5 hours to obtain a methylene-linked condensation product of aromatic sulfonic acids, which had a number average molecular weight of 5600. This condensation product was mixed with 37 g of calcium hydroxide to convert the excess sulfuric acid to gypsum, and then centrifuged to remove any insoluble solid matter. The filtrate was neutralized with ammonia and divided into five equal parts. To four of these parts were added specified amounts of aqueous solutions of polystyrenesulfonic acid sodium salt (PS-100, manufactured by Tosoh Co., Ltd.; average molecular weight 800,000–1,200,000), polyacrylic acid sodium salt (Aqualic MP-30, manufactured by Japan Catalytic Chemical Industry Co., Ltd.; average molecular weight 40,000), polyacrylamide (Hopelon A-10, manufactured by Mitsui-Toatsu Chemicals Inc.; average molecular weight 600,000–700,000) and polyethylene glycol (PEO-3, manufactured by Seitetsu Kagaku Co., Ltd.; average molecular weight 600,000–1,100,000), respectively. These liquids were filtered again through No. 5C filter paper (manufactured by Toyoroshi Kaisha, Ltd.) and then concentrated to obtain five spinning materials having a viscosity of 100 poises as measured at 65° C. with a Brookfield type viscometer. Each of these spinning materials was dry-spun using a spinneret having an orifice diameter of 0.2 mm. The spun fiber was directly subjected to a carbonization step. Specifically, the fiber was placed in a stream of $N_2$ and heated from room temperature to 1,000° C. at a rate of 200° C./min. on the average. During this carbonization process, the fiber was held at 250° C. for 5 minutes and at 1,000° C. for 5 minutes. The spinnability of the five spinning materials and some properties of the carbon fibers formed from these spinning materials are shown in Table 2.

TABLE 2

| Type of water-soluble polymeric compound | Amount added[a] (wt. %) | Water content (wt. %) | Maximum spinning speed (m/min.) | Diameter of carbon fiber (μm) | Strength of carbon fiber (kg/mm²) |
|---|---|---|---|---|---|
| Polystyrenesulfonic acid sodium salt | 0.5 | 39 | 650 | 15 | 116 |
| Polyacrylic acid sodium salt | 1.0 | 40 | 620 | 15 | 120 |
| Polyacrylamide | 1.0 | 38 | 470 | 16 | 95 |
| Polyethylene glycol | 0.8 | 41 | 780 | 14 | 135 |
| None | — | 36 | 320 | 17 | 88 |

[a]Amount added: [(Dry weight of water-soluble polymeric compound)/(Dry weight of condensation product of sulfonated creosote oil) × 100 (%).

We claim:

1. A process for producing a carbon material in fibrous form, which comprises the steps of:

preparing a raw material composition comprising a methylene type linkage-containing condensation product of an aromatic sulfonic acid or a salt thereof in an aqueous solvent, the condensation product having been formed by means of a linkage of the formula:

$$-(CH_2)_n-T_x-(CHR)_m-$$

wherein T is a benzene or naphthalene ring, R is a hydrogen atom, and alkyl group of 1 to 4 carbon atoms, or a benzene ring, and each of n, m and x is 0 or 1, but n and m are not 0 at the same time, the content of the condensation product in the composition being within the range of 20 to 80% by weight;

spinning the raw material composition into a fiber under the following conditions: (1) the spinning temperature being in the range of 20° to 100° C., (2) the draft ratio where the fiber is drawn being in the range of 100 to 2, and (3) the diameter of the spun fiber being in the range of 2 to 100 μm, and carbonizing the spun fiber.

2. The process for producing the carbon material as claimed in claim 1 wherein the linkage of formula (1) is $-CH_2-$.

3. The process for producing the carbon material as claimed in claim 1 wherein, prior to the spinning step, a water-soluble polymeric compound is added to the raw material composition in an amount of 0.02 to 20 parts by weight per 100 parts by weight of the solid constituent of the raw material composition.

4. The process for producing the carbon material as claimed in claim 1, wherein the methylene type linkage-containing condensation product of an aromatic sulfonic acid or a salt thereof is the methylene type linkage-containing condensation product of an ammonium salt of an aromatic sulfonic acid.

5. The process for producing the carbon materials claimed in claim 2, wherein the methylene type linkage-containing condensation product of an aromatic sulfonic acid or a salt thereof is the methylene type linkage containing condensation product of an ammonium salt of an aromatic sulfonic acid.

6. The process for producing the carbon material as claimed in claim 3, wherein the methylene type linkage-containing condensation product of an aromatic sulfonic acid or a salt thereof is the methylene type linkage-containing condensation product of an ammonium salt of an aromatic sulfonic acid.

* * * * *